US005705466A

United States Patent [19]

Baillely et al.

[11] Patent Number: 5,705,466

[45] Date of Patent: Jan. 6, 1998

[54] HIGH BULK DENSITY GRANULAR DETERGENTS CONTAINING A PERCARBONATE BLEACH AND A POWDERED SILICATE

[75] Inventors: Gerard Marcel Baillely; Thomas Edward Cook, both of Newcastle upon Tyne, Great Britain

[73] Assignee: The Procter & Gamble Company, Cincinnati, Ohio

[21] Appl. No.: 586,865

[22] PCT Filed: Aug. 4, 1994

[86] PCT No.: PCT/US94/08858

§ 371 Date: Jan. 24, 1996

§ 102(e) Date: Jan. 24, 1996

[87] PCT Pub. No.: WO95/05444

PCT Pub. Date: Feb. 23, 1994

[30] Foreign Application Priority Data

Aug. 17, 1993 [EP] European Pat. Off. ..... 93202404

[51] Int. Cl.[6] ..... C11D 3/395; C11D 7/18

[52] U.S. Cl. ..... 510/312; 510/309; 510/315; 510/349; 510/375; 510/376; 510/377; 510/438; 510/441; 510/511; 252/186.2; 252/186.27

[58] Field of Search ..... 510/309, 318, 510/334, 349, 375, 438, 441, 511, 312, 315, 376, 377; 252/186.2, 186.27

[56] References Cited

U.S. PATENT DOCUMENTS

| | | | |
|---|---|---|---|
| 3,950,276 | 4/1976 | Grand | 510/352 |
| 4,105,827 | 8/1978 | Brichard | 428/403 |
| 4,406,808 | 9/1983 | Gangwisch | 510/323 |
| 4,444,674 | 4/1984 | Gray | 510/313 |
| 4,869,843 | 9/1989 | Saito | 2552/186.25 |
| 4,931,203 | 6/1990 | Ahmed et al. | 510/230 |
| 5,078,895 | 1/1992 | Dany et al. | 510/313 |
| 5,219,549 | 6/1993 | Onda | 252/186.27 |

FOREIGN PATENT DOCUMENTS

| | | | |
|---|---|---|---|
| WO 94/01521 | 1/1994 | WIPO | C11D 3/10 |

*Primary Examiner*—Paul Lieberman
*Assistant Examiner*—Caroline L. Dusheck
*Attorney, Agent, or Firm*—R. C. Rasser; K. W. Zerby; K. K. Patel

[57] ABSTRACT

A granular detergent composition having a bulk density of at least 650 g/l and comprising at least 5% by weight of anionic surfactants, nonionic surfactants, or mixtures thereof, and further comprising: i) from 2% to 50% by weight of granular alkalimetal percarbonate, ii) from 0.7% to 20% by weight of powdered silicate, and wherein silicate particles having a particle size diameter of less than 425 micrometers comprise at least 0.7% by weight of the composition.

18 Claims, No Drawings

HIGH BULK DENSITY GRANULAR DETERGENTS CONTAINING A PERCARBONATE BLEACH AND A POWDERED SILICATE

The present invention relates to detergent compositions comprising percarbonate bleach. In particular it relates to compositions which have a high bulk density, improved characteristics of dispensing from either the drawer of a washing machine, or other dispensing device, thereby giving improved cleaning performance of bleaching compositions.

Inorganic perhydrate bleaches, such as perborate, percarbonate, and persilicate are well-known as detergent components. Preferably they are combined with peracid precursors which perhydrolise the perhydrate to form the active peracid. This perhydrolysis reaction is promoted by alkaline conditions.

Compositions which comprise percarbonate and peroxy carboxylic acid bleach precursors have been described in detail in the Applicants co-pending application WO9206163, published on 16th Apr., 1992.

Compositions which aim to improve dispensing characteristics of high bulk density detergents have also been described in the prior art.

EP 534525, published on 31st Mar., 1993 describes the use of particulate citric acid having a specified particle size in order to aid dispensing. Bleach compounds including percarbonate are mentioned.

However, use of particulate citric acid does not address the problem of providing alkaline conditions in the wash liquor.

The use of water-soluble alkaline inorganic salts in the composition would address this problem.

EP 229671, published on 22nd Jul., 1987 proposes the use of particulate carbonate or phosphonates in specified detergent compositions. It is claimed that improved dispersibility and solubility in cold water can be achieved.

The use of sodium silicate as a suitable particulate water-soluble alkaline inorganic salt is known to contribute to the inhibition of corrosion of washing machine drums, and to the rapid removal of heavy metal colloids from the laundry soil which would otherwise tend to destabilise the peroxygen and peracid species.

Although silicate is sparingly soluble in cold water, and therefore dry mixed, fine particles of silicate (with a particle size diameter of less than 425 micrometers) with high surface area are preferred, it has been observed that the combination of perborate monohydrate and fine soluble particles of inorganic salts, including silicate) is detrimental to the dispensing profile of the product. Attempts to replace the fine particles of silicate by coarser silicate, or to replace perborate monohydrate by perborate tetrahydrate has been found to lead to poorer cleaning performance.

It has now been found that the replacement of perborate monohydrate with some specific percarbonate materials permits the incorporation of a high level of fine, rapidly-soluble silicate particles without causing any dispensing issue, and gives excellent cleaning performance.

Consequently the detergent compositions of the present invention have both superior dispensing and superior bleaching performance.

SUMMARY OF THE INVENTION

A granular detergent composition having a bulk density of at least 650 g/l and comprising at least 5% by weight of anionic surfactants, nonionic surfactants, or mixtures thereof, and further comprising:

i) from 2% to 50% by weight of granular alkalimetal percarbonate ii) from 0.7% to 20% by weight of silicate, said silicate being in powdered form;

wherein the silicate particles having a particle size diameter of less than 425 micrometers comprise at least 0.7% by weight of the composition.

DETAILED DESCRIPTION OF THE INVENTION

A granular detergent composition having a bulk density of at least 650 g/l and comprising at least 5% by weight of anionic surfactants, nonionic surfactants, or mixtures thereof, and further comprising:

i) from 2% to 50% by weight of granular alkalimetal percarbonate ii) from 0.7% to 20% by weight of silicate, said silicate being in powdered form;

wherein the silicate particles having a particle size diameter of less than 425 micrometers comprise at least 0.7% by weight of the composition.

A particularly useful component of the present invention is at least 0.5% by weight of a peracid precursor chosen from tetraacetyl methylene diamine, tetraacetyl ethylene diamine, tetraacetyl hexylene diamine, perbenzoic acid or hydrophobic peracid precursors such as 2-phenyl 4h-3 1-benzoxazin-4-one, NOBS, iso-NOBS, benzoylcaprolactam, benzoyloxybenzenesulphonate or mixtures thereof.

Amorphous silicate which is rapidly water-soluble such as sodium silicate which has a ratio of SiO2:Na2O of less than 2.4 is preferred as component ii).

The granular percarbonate may be coated with a salt, useful coating materials include carbonate, sulphate, citrate, silicate, water-soluble anionic surfactant or mixtures of these. Most preferred as a coating material is a mixture of sodium carbonate and sodium sulphate. Where sodium silicate is used as a component of the coating material, it is preferred that it does not comprise more than 2.2% by weight of percarbonate, of sodium silicate.

Preferred compositions of the present invention comprise from 10% to 30% by weight percarbonate, and less than 3% by weight perborate monohydrate.

Without wishing to be bound by theory, it is believed that the type of percarbonate which is selected herein has a lower surface area and lower porosity than perborate monohydrate. This low surface area and low porosity prevents the co-gelling with fine particles of silicate and is therefore not detrimental to dispensing. The percarbonate material selected herein retains comparable rates of dissolution versus perborate monohydrate despite its low surface area/low porosity. In fact because it does not gel, this percarbonate material disperses and dissolves better than perborate monohydrate in real wash situations (i.e. from the dispensing drawer of a conventional washing machine or from any other dispensing device).

The components of the invention will now be described in more detail.

Water-soluble silicates which are suitable for use in the present invention may be amorphous or layered.

Such silicates may be characterised by the ratio of $SiO_2$ to $Na_2O$ in their structure. In the present invention, this ratio may typically be less than 3.3:1, preferably less than 2.8:1, more preferably less than 2.4:1, most preferably about 2.0:1.

In terms of the present invention, amorphous silicates are preferred to crystalline silicates. However, crystalline silicates may be included in compositions of the invention. Crystalline layered sodium silicates have the general formula $NaMSi_xO_{2x+1}.yH_2O$ wherein M is sodium or hydrogen, x is a number from 1.9 to 4 and y is a number from 0 to 20. Crystalline layered sodium silicates of this type are disclosed in EP-A 164 514 and methods for their preparation are disclosed in DE-A 34 17 649 and DE-A 37 42 043. For the purpose of the present invention, x in the general formula above has a value of 2, 3 or 4 and is preferably 2. More preferably M is sodium and preferred examples of this formula comprise the α, β-, γ-, δ-forms of $Na_2Si_2O_5$. These materials are available from Hoechst AG, Germany, as, respectively, NaSKS-5, NaSKS-7, NaSKS-11 and NaSKS-6. The most preferred material is γ- $Na_2Si_2O_5$, NaSKS-6.

The laundry detergent compositions incorporating the bleaching compositions of the present invention preferably comprise amorphous silicate or crystalline layered silicate at a level of from 1% to 40% by weight of the composition, more preferably from 1% to 20% by weight.

It is preferred that the silicate component of the present invention comprises less than 25% by weight of water-soluble silicate and preferably from 3% to 15% by weight. When dry added water-soluble silicate is used, it is preferred that less than 10% by weight of the finished composition is dry added water-soluble silicate.

It has now been found that the particle size of the silicate particles of the present invention can contribute to the rate at which bleaching species are generated. It is preferable that fine silicate particles are used as these particles dissolve most rapidly in the wash solution driving the alkalinity upwards. It is believed that the rate of alkalinity release promotes the perhydrolysis of the percarbonate. Preferably the fraction of silicate particles which pass through a Tyler 35 mesh (aperture size 425 micrometers) represent at least 0.7% by weight of the finished composition. Preferably the fraction of silicate particles which pass through a Tyler 35 mesh represent at least 1% by weght of the finished composition.

The upper limit on particle size of the silicate particles is generally limited by the need to have rapidly dissolving particles. In general the fraction of silicate particles above 2000 micrometers, and preferably the fraction above 1400 micrometers is considered oversize and is removed.

Many grades of particulate amorphous silicates are readily available commercially from, for example, Hoechst AG, and Akzo. The preferred grades for use in the present invention should have at least 30% by weight of the particles having a particle size diameter of less than 425 micrometers. Furthermore preferred silicates have a surface area of greater than 0.05 $m^2$/cc, and a porosity of greater than 6.5%.

Percarbonate bleach

The compositions of the present invention will include a percarbonate bleach, normally in the form of the sodium salt, as the source of alkaline hydrogen peroxide in the wash liquor. This percarbonate is normally incorporated at a level of from 3% to 35% by weight, more preferably from 5% to 30% by weight and most preferably from 8% to 25% by weight of the total composition.

Sodium percarbonate is an addition compound having a formula corresponding to $2Na_2CO_3.3H_2O_2$, and is available commercially as a crystalline solid. Most commercially available material includes a low level of a heavy metal sequestrant such as EDTA, 1-hydroxyethylidene 1, 1-diphosphonic acid (HEDP) or an amino-phosphonate, that is incorporated during the manufacturing process. For the purposes of the detergent composition aspect of the present invention, the percarbonate can be incorporated into detergent compositions without additional protection, but preferred executions of such compositions utilise a coated form of the material. The preferred coating is a mixed salt of an alkali metal sulphate and carbonate. Such coatings together with coating processes have previously been described in GB-1,466,799, granted to Interox on 9th Mar. 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is from 0.1 to 3, preferably n is from 0.3 to 1.0 and most preferably n is from 0.2 to 0.5. Another preferred coating material is sodium citrate. Water-soluble surfactants such as linear alkyl benzene sulphonate and alkyl ether sulphate may also be used as co-coating agents.

An alternative, although less preferred coating material is sodium silicate. Silicate coating materials, applied as an aqueous solution on percarbonate before drying are less preferred since they tend to affect the dispensing properties of the composition. The sodium silicate coating should not comprise more than 2.2% by weight of the percarbonate material. If used as a coating material the silicate should have a $SiO_2$:$Na_2O$ ratio from 2.0:1 to 3.4:1, preferably from 2.2:1 to 2.8:1. Magnesium silicate can also be included in the coating.

The particle size range of the crystalline percarbonate is from 100 micrometers to 1500 micrometers. Preferred materials have a particle size range between 250 and 1000 micrometers with a mean particle size of between 500 and 700 micrometers.

In order for the benefits of the present invention to be fully realised, it is highly desirable that the percarbonate material chosen can be rapidly dissolved in the wash and the active bleaching species are readily formed. In order to choose suitable percarbonate materials the available oxygen (AvO2) level can be measured using thiosulphate/potassium iodide/ammonium molybdate titration on aliquots taken from a stirred aqueous solution of the 1% wt./wt. concentration of the detergent composition which contains the percarbonate after 2, 4 and 5 minutes. A sample of the composition is dissolved in a Sotax apparatus in deionised water which has been adjusted to 25° dH water hardness by the addition of calcium chloride and magnesium chloride (with Ca:Mg= 3:1), at 10° C. The solution is stirred at 150 rpm. A given percarbonate is considered to be suitable for use in the present invention if it releases at least 40% of the total AvO2 after 2 minutes, at least 80% of the total AvO2 after 4 minutes, and at least 90% of the total AvO2 after 5 minutes.

Compositions of the present invention, which contain percarbonate, have a greatly reduced tendency to form undesirable gels in the presence of silicates, surfactants and water than similar compositions which contain perborate. Without wishing to be bound by theory, it is believed that this is because the type of percarbonate which is selected here has a lower surface area and lower porosity than perborate monohydrate. This low surface area and low porosity prevents the co-gelling with fine particles of silicate in the presence of anionic surfactants and water, and is therefore not detrimental to dispensing.

Peroxyacid Bleach Precursor

In a preferred embodiment of the present invention, the composition comprises peroxyacid bleach precursor. The solid peroxyacid bleach precursors of the present invention comprise precursors containing one or more N- or O- acyl groups, which precursors can be selected from a wide range of classes.

Suitable classes include anhydrides, esters, imides and acylated derivatives of imidazoles and oximes, and examples of useful materials within these classes are disclosed in GB-A-1586789. The most preferred classes are esters such as are disclosed in GB-A-836988, 864,798, 1147871 and 2143231 and imides such as are disclosed in GB-A-855735 & 1246338.

Particularly preferred precursor compounds are the N,N, $N^1N^1$ tetra acetylated compounds of formula

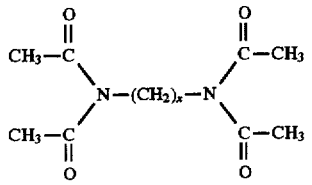

wherein x can be 0 or an integer between 1 & 6.

Examples include tetra acetyl methylene diamine (TAMD) in which x=1, tetra acetyl ethylene diamine (TAED) in which x=2 and tetraacetyl hexylene diamine (TAHD) in which x=6. These and analogous compounds are described in GB-A-907356. The most preferred peroxyacid bleach precursor is TAED.

Other preferred bleach precursors are the perbenzoic acid precursors such as benzoyloxybenzene sulphonate (BOBS), benzoylcaprolactam, acyloxybenzene sulphonates (NOBS, iso-NOBS), sugar derivatives (PAG, TAG, and those described in EP 257039), malonate derivatives (described in EP 517482), cationic precursors (described in EP 512533, EP 508623 and EP 405152), glycolate esters (described in EP507475) and 2-phenyl 4h-3 1-benzoxazin-4-one.

Bleach precursors will normally be in fine powder or crystalline form in which at least 90% by weight of the powder has a particle size of less than 150 micrometers. However such solid bleach precursors are generally reagglomerated, granulated, encapsulated or spray dried with other components. Such peroxyacid bleach precursor granules are dry blended in the detergent composition and generally have a particle size range of from 300 micrometers to 1500 micrometers. Some bleach precursors are pasty or liquid at room temperature and have to be granulated with porous substrates such as zeolite or silica.

It is most preferred that a peroxyacid bleach precursor is present at a level of at least 0.5% by weight of the composition. These peroxyacid bleach precursors can be partially replaced by preformed peracids such as N,N phthaloylaminoperoxy acid (PAP), nonyl amide of peroxyadipic acid (NAPAA), 1,2 diperoxydodecanedioic acid (DPDA) and trimethyl ammonium propenyl imidoperoxy mellitic acid (TAPIMA).

Surfactants and Builders

A wide range of surfactants can be used in the detergent compositions. A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981.

The finished compositions of the present invention will preferably contain from 2% by weight to 30% by weight, and preferably from 5% to 25% by weight of anionic surfactant.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon-atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Mixtures of anionic surfactants are suitable herein, particularly blends of sulphate, sulphonate and/or carboxylate surfactants. Mixtures of sulphonate and sulphate surfactants are normally employed in a sulphonate to sulphate weight ratio of from 5:1 to 1:2, preferably from 3:1 to 2:3, more preferably from 3:1 to 1:1. Preferred sulphonates include alkyl benzene sulphonates having from 9 to 15, most preferably from 11 to 13 carbon atoms in the alkyl radical, and alpha-sulphonated methyl fatty acid esters in which the fatty acid is derived from a $C_{12}$–$C_{18}$ fatty source, preferably from a $C_{16}$–$C_{18}$ fatty source. In each instance the cation is an alkali metal, preferably sodium. Preferred sulphate surfactants in such sulphonate sulphate mixtures are alkyl sulphates having from 12 to 22, preferably 16 to 18 carbon atoms in the alkyl radical. Another useful surfactant system comprises a mixture of two alkyl sulphate materials whose respective mean chain lengths differ from each other. One such system comprises a mixture of $C_{14}$–$C_{15}$ alkyl sulphate and $C_{16}$–$C_{18}$ alkyl sulphate in a weight ratio of $C_{14}$–$C_{15}$: $C_{16}$–$C_{18}$ of from 3:1 to 1:1. The alkyl sulphates may also be combined with alkyl ethoxy sulphates having from 10 to 20, preferably 10 to 16 carbon atoms in the alkyl radical and an average degree of ethoxylation of 1 to 6. The cation in each instance is again an alkali metal, preferably sodium.

Other anionic surfactants suitable for the purposes of the invention are the alkali metal sarcosinates of formula $$R—CON(R)CH_2COOM$$

wherein R is a $C_9$–$C_{17}$ linear or branched alkyl or alkenyl group, R' is a $C_1$–$C_4$ alkyl group and M is an alkali metal ion. Preferred examples are the lauroyl, Cocoyl ($C_{12}$–$C_{14}$), myristyl and oleyl methyl sarcosinates in the form of their sodium salts.

Also useful are the sulphonation products of fatty acid methyl esters containing a alkyl group with from 10 to 20 carbon atoms. Preferred are the C16–18 methyl ester sulphonates (MES), or mixtures of C16–18 and C12–14 methyl ester sulphonates.

One class of nonionic surfactants useful in the present invention comprises condensates of ethylene oxide with a hydrophobic moiety, providing surfactants having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–9 moles of ethylene oxide per mole of alcohol, particularly the $C_{13}$–$C_{15}$ primary alcohols containing 6–9 moles of ethylene oxide per mole of alcohol and the $C_{11}$–$C_{15}$ primary alcohols containing 3–5 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent compositions are disclosed in EP-B 0070074, 0070077, 0075996 and 0094118.

Still another class of nonionic surfactants comprises polyhydroxy fatty acid amides which may be produced by reacting a fatty acid ester and an N-alkyl polyhydroxy amine. The preferred amine for use in the present invention is N—(R1)—CH2(CH2OH)4—CH2—OH and the preferred ester is a C12–C20 fatty acid methyl ester. Most preferred is the reaction product of N-methyl glucamine with C12–C20 fatty acid methyl ester.

Methods of manufacturing polyhydroxy fatty acid amides have been described in WO 92 6073, published on 16th Apr., 1992. This application describes the preparation of polyhydroxy fatty acid amides in the presence of solvents. In a highly preferred embodiment of the invention N-methyl glucamine is reacted with a C12–C20 methyl ester. It also says that the formulator of granular detergent compositions may find it convenient to run the amidation reaction in the presence of solvents which comprise alkoxylated, especially ethoxylated (EO 3–8) C12–C14 alcohols.

A further class of surfactants are the semi-polar surfactants such as amine oxides. Suitable amine oxides are selected from mono $C_8$–$C_{20}$, preferably $C_{10}$–$C_{14}$ N-alkyl or alkenyl amine oxides and propylene-1,3-diamine dioxides wherein the remaining N positions are substituted by methyl, hydroxyethyl or hydroxpropyl groups.

Cationic surfactants can also be used in the detergent compositions herein and suitable quaternary ammonium surfactants are selected from mono $C_8$–$C_{16}$, preferably $C_{10}$–$C_{14}$ N-alkyl or alkenyl ammonium surfactants wherein remaining N positions are substituted by methyl, hydroxyethyl or hydroxypropyl groups.

The surfactant containing particles will further comprise components selected from a wide range of possible ingredients which are commonly used in laundry detergents. Preferably the particles will contain some detergent builder:

These can include, but are not restricted to alkali metal carbonates, bicarbonates, silicates, aluminosilicates, monomeric polycarboxylates, homo or copolymeric polycarboxylic acids or their salts in which the polycarboxylic acid comprises at least two carboxylic radicals separated from each other by not more than two carbon atoms, organic phosphonates and aminoalkylene poly (alkylene phosphonates) and mixtures of any of the foregoing. The builder system is present in an amount of from 25% to 60% by weight of the composition, more preferably from 30% to 60% by weight.

Preferred builder systems are free of boron compounds and any polymeric organic materials are preferably biodegradable.

Whilst a range of aluminosilicate ion exchange materials can be used, preferred sodium aluminosilicate zeolites have the unit cell formula $$Na_z[(AlO_2)_z(SiO_2)y]xH_2O$$

wherein z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline, containing from 10% to 28%, more preferably from 18% to 22% water in bound form.

The above aluminosilicate ion exchange materials are further characterised by a particle size diameter of from 0.1 to 10 micrometers, preferably from 0.2 to 4 micrometers. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein are still further characterised by their calcium ion exchange rate which is at least 130 mg equivalent of $CaCO_3$/liter/minute/(g/liter) [2 grains $Ca^{++}$/ gallon/minute/gram/gallon)] of aluminosilicate (anhydrous basis), and which generally lies within the range of from 130 mg equivalent of $CaCO_3$/liter/minute/(gram/liter) [2 grains/gallon/minute/(gram/gallon)] to 390 mg equivalent of $CaCO_3$/liter/minute/(gram/liter) [6 grains/gallon/minute/(gram/gallon)], based on calcium ion hardness.

Optimum aluminosilicates for builder purposes exhibit a calcium ion exchange rate of at least 260 mg equivalent of $CaCO_3$/liter/ minute/(gram/liter) [4 grains/gallon/minute/(gram/gallon)].

Aluminosilicate ion exchange materials useful in the practice of this invention are commercially available and can be naturally occurring materials, but are preferably synthetically derived. A method for producing aluminosilicate ion exchange materials is discussed in U.S. Pat. No. 3,985,669. Preferred synthetic crystalline aluminosilicate ion exchange materials useful herein are available under the designations Zeolite A, Zeolite B, Zeolite X, Zeolite HS, Zeolite MAP and mixtures thereof. In an especially preferred embodiment, the crystalline aluminosilicate ion exchange material is Zeolite A and has the formula $$Na_{12}[AlO_2)_{12}\ (SiO_2)_{12}].\ xH_2O$$

wherein x is from 20 to 30, especially 27. Zeolite x of formula $Na_{86}$ $[(AlO_2)_{86}(SiO_2)_{106}]$. 276 $H_2O$ is also suitable, as well as Zeolite HS of formula $Na_6$ $[(AlO_2)_6(SiO_2)_6]7.5$ $H_2$ O).

Suitable water-soluble monomeric or oligomeric carboxylate builders include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates or citric acid, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Another preferred polycarboxylate builder is ethylenediamine-N,N'-disuccinic acid (EDDS) or the alkali metal, alkaline earth metal, ammonium, or substituted ammonium salts thereof, or mixtures thereof.

Alicyclic and heterocyclic polycarboxylates include cyclopentane-cis,cis,cis-tetracarboxylates, cyclopentadienide pentacarboxylates, 2,3,4,5-tetrahydrofuran - cis, cis, cis-tetracarboxylates, 2,5-tetrahydrofuran - cis - dicarboxylates, 2,2,5,5- tetrahydrofuran - tetracarboxylates, 1,2,3,4,5,6-hexane - hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343. Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems of detergent compositions in accordance with the present invention.

Other suitable water soluble organic salts are the homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from 20,000 to 70,000, especially about 40,000. Such builder polymeric materials may be identical to the polymeric materials as binder materials and coating materials, as described hereinabove. These materials are normally used at levels of from 0.5% to 10% by weight more preferably from 0.75% to 8%, most preferably from 1% to 6% by weight of the composition.

Organic phosphonates and amino alkylene poly (alkylene phosphonates) include alkali metal ethane 1-hydroxy diphosphonates, nitrilo trimethylene phosphonates, ethylene diamine tetra methylene phosphonates and diethylene triamine penta methylene phosphonates, although these materials are less preferred where the minimisation of phosphorus compounds in the compositions is desired.

The particle or particles which contain the surfactant and builder may be made by any convenient process. Examples of useful processing routes include spray drying, agglomeration, extrusion, prilling etc. One particularly preferred processing route for making high bulk density, high detergent active particles is by agglomerating detergent powders and highly viscous surfactant pastes in a high shear mixer. A more detailed description of such a process is given in the Applicants' co-pending application EP510746, published on 28th Oct., 1992.

Examples of other components which may be used in laundry detergents, and which may be incorporated into the surfactant particles are described below under "Optional Ingredients".

Optional Ingredients

Detergent Compositions of the present invention may, optionally, include anti-redeposition and soil suspension agents, bleach activators, optical brighteners, soil release agents, suds suppressors, enzymes, fabric softening agents, perfumes and colours, as well as other ingredients known to be useful in laundry detergents.

Anti-redeposition and soil-suspension agents suitable herein include cellulose derivatives such as methylcellulose, carboxymethylcellulose and hydroxyethycellulose, and homo-or co-polymeric polycarboxylic acids or their salts. Polymers of this type include copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Preferred optical brighteners are anionic in character, examples of which are disodium $4,4^1$-bis-(2-diethanolamino-4-anilino -s- triazin-6- ylamino)stilbene-$2:2^1$ disulphonate, disodium $4,4^1$-bis-(2-morpholino -4-anilino-2-triazin-6-ylaminostilbene-$2:2^1$-disulphonate, disodium 4, $4^1$-bis-(2,4-dianilino-s-triazin-6-ylamino) stilbene-$2:2^1$-disulphonate, monosodium $4^1,4^{11}$-bis-(2,4-dianilino-s-triazin-6 ylamino)stilbene-2- sulphonate, disodium $4,4^1$-bis( 2-anilino-4-(N-methyl-N-2-hydroxyethylamino)-2-triazin-6-ylamino)stilbene-$2,2^1$-disulphonate, disodium $4,4^1$-bis-(4-phenyl-2,1,3-triazol-2-yl)stilbene-$2,2^1$ disulphonate, disodium $4,4^1$bis(2-anilino-4-(1-methyl-2-hydroxyethylamino)-s-triazin-6-ylamino) stilbene-$2,2^1$disulphonate and sodium 2(stilbyl-$4^{11}$-(naphtho-$1^1,2^1$:4,5)-1,2,3 - triazole-$2^{11}$- sulphonate.

Soil-release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0272033. A particular preferred polymer in accordance with EP-A-0272033 has the formula $$(CH_3(PEG)_{43})_{0.75}(POH)_{0.25}(T—PO)_{2.8}(T—PEG)_{0.2}]T(PO—H)_{0.25}((PEG)_{43}CH_3)_{0.75}$$

where PEG is $—(OC_2H_4)O—$, PO is $(OC_3H_6O)$ and T is $(pCOC_6H_4CO)$.

Certain polymeric materials such as polyvinyl pyrrolidones typically of MWt 5000–20000, preferably 10000–15000, also form useful agents in preventing the transfer of labile dyestuffs between fabrics during the washing process.

Another optional detergent composition ingredient is a suds suppressor, exemplified by silicones, and silica-silicone mixtures. Silicones can be generally represented by alkylated polysiloxane materials while silica is normally used in finely divided forms, exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent-impermeable carrier. Alternatively the suds suppressor can be dissolved or dispersed in a liquid carrier and applied by spraying on to one or more of the other components.

As mentioned above, useful silicone suds controlling agents can comprise a mixture of an alkylated siloxane, of the type referred to hereinbefore, and solid silica. Such mixtures are prepared by affixing the silicone to the surface of the solid silica. A preferred silicone suds controlling agent is represented by a hydrophobic silanated (most preferably trimethyl-silanated) silica having a particle size in the range from 10 nanometers to 20 nanometers and a specific surface area above 50 $m^2/g$, intimately admixed with dimethyl silicone fluid having a molecular weight in the range from about 500 to about 200,000 at a weight ratio of silicone to silanated silica of from about 1:1 to about 1:2.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2,646,126 published Apr. 28, 1977. An example of such a compound is DC0544, commercially available from Dow Corning, which is a siloxane/glycol copolymer.

The suds suppressors described above are normally employed at levels of from 0.001% to 0.5% by weight of the composition, preferably from 0.01% to 0.1% by weight.

The preferred methods of incorporation comprise either application of the suds suppressors in liquid form by spray-on to one or more of the major components of the composition or alternatively the formation of the suds suppressors into separate particulates that can then be mixed with the other solid components of the composition. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Another optional ingredient useful in the present invention is one or more enzymes.

Preferred enzymatic materials include the commercially available amylases, neutral and alkaline proteases, lipases, esterases and cellulases conventionally incorporated into detergent compositions. Suitable enzymes are discussed in U.S. Pat. Nos. 3,519,570 and 3,533,139.

Fabric softening agents can also be incorporated into detergent compositions in accordance with the present invention. These agents may be inorganic or organic in type. Inorganic softening agents are exemplified by the smectite clays disclosed in GB-A-1,400,898. Organic fabric softening agents include the water insoluble tertiary amines as disclosed in GB-A-1514276 and EP-B-0011340.

Their combination with mono $C_{12}$–$C_{14}$ quaternary ammonium salts is disclosed in EP-B-0026527 & 528. Other useful organic fabric softening agents are the dilong chain amides as disclosed in EP-B-0242919. Additional organic ingredients of fabric softening systems include high molecular weight polyethylene oxide materials as disclosed in EP-A-0299575 and 0313146.

Levels of smectite clay are normally in the range from 5% to 15%, more preferably from 8% to 12% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight, whilst the high molecular weight polyethylene oxide materials and the water soluble cationic materials are added at levels of from 0.1% to 2%, normally from 0.15% to 1.5% by weight. Where a portion of the composition is spray dried, these materials can be added to the aqueous slurry fed to the spray drying tower, although in some instances it may be more convenient to add them as a dry mixed particulate, or spray them as a molten liquid on to other solid components of the composition.

EXAMPLES

The following samples of sodium silicate having a ratio of $SiO_2$:$Na_2O$ of 2.0 were used:

| | Silicate A | Silicate B |
|---|---|---|
| Sieve fractions | | |
| >1180 um | 0.0% | 3.3% |
| 1180 > x > 710 um | 0.0% | 35.5% |
| 710 um > x > 425 um | 1.2% | 37.4% |
| 425 um > x > 250 um | 12.2% | 19.3% |
| 250 > x > 150 | 38.5% | 0.5% |
| 150 > x | 48.2% | 0.7% |
| Porosity | 15% | 6% |
| Specific surface area* | 0.117 $m^2/cc$ | 0.0200 $m^2/cc$ |

*Specific Surface area was measured with a Malvern M7.09 instrument

In these examples the following abbreviations have been used:

| | |
|---|---|
| DTPMP: | Diethylene triamine penta (methylene phosphonic acid); supplied by Monsanto as Dequest 2060 (trade name). |
| Sokolan CP5: | Co-polymer of acrylic and maleic acid, supplied by BASF. |
| C14/15AE7: | Ethoxylated alcohol having an alkyl chain length of predominantly C14 to C15 and an average of 7 ethoxy groups per molecule |
| C16/18AE11: | Ethoxylated alcohol having an alkyl chain length of predominantly C16 to C18 and an average of 11 ethoxy groups per molecule |
| LAS: | linear alkyl benzene sulphonate |
| C16/18AS: | Alkyl sulphate having a alkyl chain length of predominantly C16 to C18 |
| CMC: | Carboxy methyl cellulose |
| PB1: | Sodium perborate, monohydrate |
| PB4: | Sodium perborate, tetrahydrate |
| TAED: | N,N,N,N-tetraacetylethylene diamine |
| Percarbonate: | Sodium percarbonate having 13% AvO2, coated 2.5% Carbonate/Sulphate |

The following formulations were prepared:

| | | Example 1 INVENTION | Example 2 Comparative | Example 3 Comparative |
|---|---|---|---|---|
| | Spray dried Granule | | | |
| a) | Zeolite A | 13% | 13% | 13% |
| b) | DTPMP | 0.4% | 0.4% | 0.4% |
| c) | Sokalan CP5 Agglomerate (mean particle size of 600 micrometers) | 4% | 4% | 4% |
| d) | LAS | 7% | 7% | 7% |
| e) | C16/18AS | 2% | 2% | 2% |
| f) | Zeolite A | 7% | 7% | 7% |
| g) | Sodium carbonate | 10% | 10% | 10% |

-continued

| | | Example 1 INVENTION | Example 2 Comparative | Example 3 Comparative |
|---|---|---|---|---|
| h) | CMC | 0.3% | 0.3% | 0.3% |
| | Spray on | | | |
| i) | C14/15AE7 | 4% | 4% | 4% |
| j) | C16/16AE11 | 1% | 1% | 1% |
| k) | Suds suppressor | 0.5% | 0.5% | 0.5% |
| | Dry additives | | | |
| l) | Sodium Carbonate | 5% | 5% | 5% |
| m) | Citrate | 5% | 5% | 5% |
| n) | TAED | 5% | 5% | 5% |
| o) | PB1 | — | 12% | 12% |
| p) | PB4 | — | 8% | 8% |
| q) | Percarbonate | 20% | — | — |
| r1) | Silicate A (level < 425 micrometers) | 3% (2.96%) | 3% (2.96%) | — |
| r2) | Silicate B (level < 425 micrometers) | — — | — — | 3% (0.62%) |
| | Balance to (moisture/miscellaneous) | 100% | 100% | 100% |
| | % AvO2 ex Peroxygen source | 2.60 | 2.62 | 2.62 |

The spray dried granules were made by preparing an aqueous slurry containing components a) to c) and spraying it into a conventional drying tower.

The agglomerates were prepared by making a viscous aqueous paste containing components d) and e) and agglomerating it with powders f) to h) in a high speed mixer. The agglomerates were then dried in a fluid bed mixer before overspraying with components i) to k).

The spray dried granules and agglomerates were then dry mixed with powder components l) to r).

The rates of alkalinity release of examples 1, 2 and 3 was compared:

In the beaker of a Sotax apparatus, 10 g of product is added with 5 mls of a N HCl acid to 11 of water having a hardness of 25 DH (3:1 Calcium Magnesium). The temperature of the solution is maintained at 20C and agitated with a constant agitation (100 rpm via a propeller agitator). The HCl addition mimics the level of acidic soil provided by a very soiled load. The pH is measured after different periods of time. The experiment is run for Example 1, 2 and 3.

| pH after | Example 1 | Example 2 | Example 3 |
|---|---|---|---|
| 10 seconds | 8.6 | 8.6 | 7.0 |
| 20 seconds | 9.2 | 9.1 | 8.3 |
| 30 seconds | 9.5 | 9.2 | 8.5 |
| 60 seconds | 9.8 | 9.5 | 9.0 |
| 10 minutes | 10.0 | 9.9 | 9.4 |

This shows that examples 1 and 2 with their higher level of silicate particles below 425 micrometers improves dramatically the rate of alkalinity release in a wash solution compared with example 3. This explains why example 3 performs less well than examples 1 and 2.

Comparative example 2 has a poor dispensing profile but a good rate of alkalinity release. This is due to the presence of small silicate particles in combination with perborate bleach.

Comparative example 3 has a good dispensing profile but a poor rate of alkalinity release. This is due to the presence of large silicate particles in combination with perborate bleach.

Example 1 has a good dispensing profile and a good rate of alkalinity release. This is due to the presence of small silicate particles in combination with percarbonate bleach.

Compositions of examples 1, 2 and 3 were tested in realistic washing conditions in a washing machine. Example 1 was found to outperform both comparative examples 2 and 3 over a wide range of stains, especially at low washing temperatures.

We claim:

1. A granular detergent composition having a bulk density of at least 650 g/l and comprising at least 5% by weight of anionic surfactants, nonionic surfactants, or mixtures thereof, and further comprising:

i) from 2% to 50% by weight of granular alkali metal percarbonate having a particle size range of from 100 micrometers to 1500 micrometers; and ii) from 0.7% to 20% by weight of an amorphous sodium silicate having an $SiO_2$:$Na_2O$ molar ratio of less than 3.3:1 said amorphous sodium silicate being in powdered form;

wherein sodium silicate particles having a particle size diameter of less than 425 micrometers comprise at least 0.7% by weight of the composition.

2. A granular composition according to claim 1 wherein said composition further comprises at least 0.5% by weight of a peracid precursor selected from the group consisting of tetraacetyl methylene diamine, tetraacetyl ethylene diamine, tetraacetyl hexylene diamine, 2-phenyl 4h-3 1-benzoxazin-4-one, acyloxybenzene sulphonates, benzoylcaprolactam, benzoyloxybenzene sulphonate and mixtures thereof.

3. A granular composition according to claim 1 wherein sodium silicate particles having a particle size of diameter less than 425 micrometers comprise at least 1% by weight of the composition.

4. A granular composition according to claim 3 wherein said amorphous sodium silicate has a ratio of $SiO_2$:$Na_2O$ of less than 2.4.

5. A granular composition according to claim 1 wherein said percarbonate is coated with a coating material which comprises a soluble salt other than said amorphous sodium silicate and wherein the weight ratio of the coating material to percarbonate is in the range of from 1:200 to 1:4.

6. A granular composition according to claim 5 wherein said coating material is selected from the group consisting of carbonates, sulphates, citrates, silicates other than said amorphous sodium silicate, water-soluble anionic surfactants and mixtures thereof.

7. A granular composition according to claim 6 wherein said coating material is a mixture of sodium carbonate and sodium sulphate.

8. A granular composition according to claim 5 where said percarbonate is coated with an amount of a second sodium silicate other than said amorphous sodium silicate, wherein the level of second sodium silicate coating the percarbonate is no more than 2.2% by weight of the percarbonate.

9. A granular composition according to claim 1 wherein said composition comprises from 10% to 30% by weight percarbonate, and less than 3% by weight perborate monohydrate.

10. A composition according to claim 1 wherein the amorphous sodium silicates have a surface area of greater than 0.05 $m^2$/cc, and a porosity of greater than 6.5%.

11. A composition according to claim 2 wherein the peracid precursor is dry blended in the detergent composition and has a particle range of from 300 micrometers to 1500 micrometers.

12. A granular composition according to claim 5 wherein said coating material is selected from the group consisting of carbonates, sulphates, citrates, water-soluble anionic surfactants and mixtures thereof.

13. A granular detergent composition comprising:

i) from 2% to 50%, by weight of the composition, crystalline alkali metal percarbonate having a particle size range of from 100 micrometers to 1500 micrometers; and ii) from 1% to 20%, by weight of the composition, powdered amorphous sodium silicates having a $SiO_2$:$Na_2O$ ratio of less than 3.3:1;

wherein the bulk density of the composition is at least 650 g/l; sodium silicate particles having a particle size diameter of less than 425 micrometers comprise at least 0.7% by weight of the composition; and the composition comprises less than 3% by weight perborate monohydrate.

14. A composition according to claim 13 further comprising from 0.5% to 5% by weight of the composition, peroxyacid bleach precursor.

15. A composition according to claim 13 wherein the percarbonate is coated with a coating material selected from the group consisting of sodium sulphate, sodium carbonate, sodium citrate, linear benzene sulphonate, alkyl ether sulphate, magnesium silicate, and mixtures thereof; and wherein the weight ratio of the coating material to percarbonate is from 1:200 to 1:4.

16. A composition according to claim 12 further comprising sodium aluminosilicate zeolite of the formula:

$$Na_z\{(AlO_2)_z(SiO_2)_y\}.xH_2O$$

wherein z and y are at least 6, the molar ratio of z to y is from 1.0 to 0.05, and x is at least 5; and wherein the sodium aluminosilicate zeolite has a particle size diameter of from 0.1 to 10 micrometers, a calcium ion exchange capacity of at least 200 mg equivalent of $CaCO_3$ water hardness/g of aluminosilicate, and a calcium ion exchange rate of at least 130 mg equivalent of $CaCO_3$/liter/minute/(g/liter).

17. A composition according to claim 14 wherein at least 90% by weight of the bleach precursor has a particle size of less than 150 micrometers.

18. A composition according to claim 13 wherein the powdered sodium silicate is dry mixed in the granular detergent.

* * * * *